United States Patent [19]

Doherty

[11] Patent Number: 4,792,234

[45] Date of Patent: Dec. 20, 1988

[54] PORTABLE CONCRETE BATCH PLANT

[75] Inventor: Jerome J. Doherty, Berthoud, Colo.

[73] Assignee: Port-A-Pour, Inc., Berthoud, Colo.

[21] Appl. No.: 816,421

[22] Filed: Jan. 6, 1986

[51] Int. Cl.[4] ..... B28C 7/16; B28C 7/06; B28C 5/18

[52] U.S. Cl. ..... 366/14; 366/18; 366/27; 366/34; 366/44; 366/59

[58] Field of Search ..... 366/10, 14, 59, 18, 366/19, 27, 30, 33, 34, 49, 62, 151, 152, 154, 41, 44; 406/19, 23

[56] References Cited

U.S. PATENT DOCUMENTS

| | | | |
|---|---|---|---|
| 2,029,126 | 1/1936 | Rybeck | 366/44 |
| 2,199,289 | 4/1940 | Johnson | 366/14 |
| 2,557,358 | 6/1951 | Martinson | 366/41 X |
| 2,813,702 | 11/1957 | Thomas | 366/154 |
| 3,064,832 | 11/1962 | Heltzel . | |
| 3,185,450 | 5/1965 | Duecy | 366/49 X |
| 3,295,698 | 1/1967 | Ross et al. . | |
| 3,746,313 | 7/1973 | Weeks . | |
| 3,768,784 | 10/1973 | Spellman, Jr. | 366/49 |
| 3,820,762 | 6/1974 | Bostrom et al. | 366/18 |
| 3,877,682 | 4/1975 | Moss | 366/153 X |
| 3,888,468 | 6/1975 | Albin | 366/14 X |
| 3,945,619 | 3/1976 | Taibi . | |
| 3,998,436 | 12/1976 | Allen et al. . | |
| 4,156,546 | 5/1979 | Hine et al. | 406/23 |
| 4,189,237 | 2/1980 | Bake . | |
| 4,285,598 | 8/1981 | Horton . | |
| 4,339,204 | 7/1982 | Placzek . | |
| 4,345,858 | 8/1982 | Barlow | 406/23 X |
| 4,403,863 | 9/1983 | Fukushima et al. | 366/19 X |
| 4,523,854 | 6/1985 | Beckley | 366/152 X |

FOREIGN PATENT DOCUMENTS

| | | | |
|---|---|---|---|
| 133239 | 10/1951 | Sweden | 366/30 |
| 1224655 | 3/1971 | United Kingdom | 366/18 |

*Primary Examiner*—Harvey C. Hornsby
*Assistant Examiner*—Scott J. Haugland
*Attorney, Agent, or Firm*—Fields, Lewis, Pittenger & Rost

[57] ABSTRACT

The invention comprises a mobile concrete batch plant transportable by highway as a single unit. A cement storage hopper, a cement weigh hopper, and an aggregate weigh hopper are mounted on a standard trailer bed. The cement hopper is loaded to the desired weight from the storage bin, and the aggregate hopper is loaded as desired by a front end loader. A charging conveyor carries discharged cement and aggregate from the hoppers to a point above two oppositely facing mixing drums. The charge is dumped from the conveyor into a load hopper, and from there into a load diverter which directs it into a selected one of the two drums. Water and admixture are added and the mixing drum rotates, mixing the contents and producing concrete. The finished concrete is removed from the drum by reversing the rotation thereof, and is carried from the plant by a discharge conveyor. A second batch may be begun while the first is being mixed or discharged.

1 Claim, 7 Drawing Sheets

PORTABLE CONCRETE BATCH PLANT

TECHNICAL FIELD

This invention relates to concrete batch plants for mixing concrete to specifications at a job site, and more particularly to an improved mobile batch plant adapted for highway transportation as a single unit.

BACKGROUND ART

In providing freshly mixed concrete to construction sites, it is necessary that the various ingredients for making the concrete be mixed in accurate proportions and for the proper length of time to ensure that the resulting concrete will meet the specifications of the particular construction job. Concrete mixing trucks are often used for this purpose, but suffer from several disadvantages. Such trucks are only efficient when used in the simultaneous mixing and transportation of a large amount of concrete. The concrete must be ready-mixed, as the trucks have no metering capabilities. This requires an expensive stationary proportioning plant for metering all the concrete materials. When the contents of the mixing drum are greater than the concrete requirement at the job site, the remainder must be quickly unloaded, often wastefully. If a loaded truck breaks down, it is necessary to manually unload the concrete before it can set inside the drum. The distance from the stationary plant to the job site is limited by the maximum mixing time of the concrete. Additionally, the time spent by the trucks in travelling between the job site and the stationary plant is non-productive.

One solution to the disadvantages of the stationary plant and mixing truck combination described above is the on-site erection of a portable batch plant. Such plants are typically very large, cannot be transported as a single unit, and require extensive on-site erection work. The on-site mixing of dry materials, particularly cement can also release large quantities of dust into the air, creating an air-polution problem. U.S. Pat. No. 3,064,832 to Heltzel shows such a portable plant. While the plant of Heltzel is transportable as a single unit, it still requires on-site erection time of approximately 2⅜ hours (column 1, line 19). In addition, the Heltzel plant has no mixing drum, and thus still requires the use of a mixing truck. Plants of a similar nature to Heltzel are provided by U.S. Pat. Nos. 3,998,436 to Allen, et al.; 3,295,698 to Ross, et al.; and 3,945,619 to Taibi. Portble batch plants shown by U.S. Pat. Nos. 4,189,237 to Bake, 4,339,204 to Placzek, 4,285,598 to Horton, and 3,746,313 to Weeks each provide a single mixing drum as part of the plant. Having only a single drum effectively reduces the capacity of these plants, however, since a relatively large proportion of available equipment time must be spent waiting for one batch to finish the mixing step before continuing preparation of the next succeeding bath. This discontinuous plant operation is a disadvantage where job requirements demand a continuous supply of concrete.

DISCLOSURE OF THE INVENTION

In accordance with this invention, a mobile concrete batch plant is provided for on-site production of concrete. In one form, the plant includes a trailer bed upon which are mounted the various other parts of the invention, and which allows the plant to be transported by highway as a single unit. A cement storage bin is mounted on the bed and is filled with cement from an external source, such as a truck. A cement weigh hopper is connected to the cement storage bin by a duct, which transfers the desired weight of cement from the bin to the hopper as determined by a weigh scale located on the hopper. The hopper has a gate in the bottom for discharging its contents onto a charging conveyor running underneath the hopper. An aggregate weigh hopper is provided which also has a weigh scale and a discharge gate in its bottom, and which is loaded to the desired weight by an external source, typically a front-end loader. The charging conveyor extends under the weigh hoppers and ends above a load hopper to which it delivers its contents. The load hopper is positioned above a diverter which receives the contents of the load hopper and diverts them into a selected one of two oppositely facing mixing drums. A measured amount of water is also added to the drums, either from a storage area within the plant, or from an external source. The drums then mix their contents by means of an auger to form concrete according to specifications. Once produced, the concrete is removed from the drums onto a discharge conveyor by reversing the auger. While one drum is in the mixing stage preparation of another batch of concrete can proceed, using the other drum.

More particularly, the plant includes a cement loading plow attached to the bottom of the cement hopper. The plow has a wedge-shaped tip directly in front of the discharge and parallel sides extending backward from the outer edges of the wedge. The wedge points upstream relative to the conveyor, and the entire plow has a clearance over the conveyor small enough to prevent the aggregate from flowing between the plow and the conveyor. Thus, the wedge plows a furrow into the aggregate as it flows past the wedge, and the sides of the plow extend the furrow backward along their length separating the aggregate into two parallel streams. Cement from the hopper is deposited into the furrow between the streams which help to contain the dust from the cement. Additionally, this dust-limiting effect may be enhanced by constructing the conveyor with side rollers which slope downward toward the center of the conveyor, thus, forming the conveyor into a curved shape so that the aggregate from each stream folds back over the cement. This not only helps to contain the cement dust, but also serves to prevent the raw materials from falling off the conveyor. A center roller may be added for further support of the conveyor. Advantageously, the cement storage bin and the cement weigh hopper can be constructed so that they are entirely enclosed except for their discharge gates. A system of ducts having an air pump and air filters and connecting the bin and the hopper fluidizes the cement for movement through the plant.

As a further addition, admixture storage barrels in communication with the mixing drums through pipes or hoses may be added for providing admixture to the mixing drums. Finally, automatic controls can be provided which allow a single centrally located operator to deliver measured amounts of aggregate, cement, water, and admixtures to the mixing drum and to mix the contents of the drum for a predetermined amount of time. The controls also have safety relay coils and contacts which prevent the plant from being operated in such a way as to cause certain undesirable occurrences. For example, the hopper gates may be prevented from opening when the conveyor is not moving and the conveyor may be rendered inoperable when the diverter is not properly oriented for delivery of the charge.

Based on the foregoing, a number of advantages of the present invention are readily apparent. A unique mobile batching plant is provided which is entirely self-contained and can be transported by highway as a single unit, resulting in reduced set-up time and allowing on-site production of concrete with a minimum of equipment. Two mixing drums are provided by the plant, thus allowing for more continuous utilization of equipment and effectively increasing the plant capacity. In a preferred embodiment, a cement loading trough having a wedge at one end creates a furrow in the aggregate charge o separate it into two parallel streams on the charging conveyor. The cement is loaded into this furrow, providing containment of the cement dust. The use of a curved conveyor further reduces the cement dust problem by closing the furrow onto the cement, and also assuring that materials do not fall off the conveyor. Automatic controls may be provided which improve efficiency and allow one person to operate the plant. The plant can be set up in about 30 minutes and requires no external equipment for its erection.

Additional advantages of this invention will become apparent from the description which follows, together with the accompanying drawings.

BEST MODE FOR CARRYING OUT THE INVENTION

Figure 1:
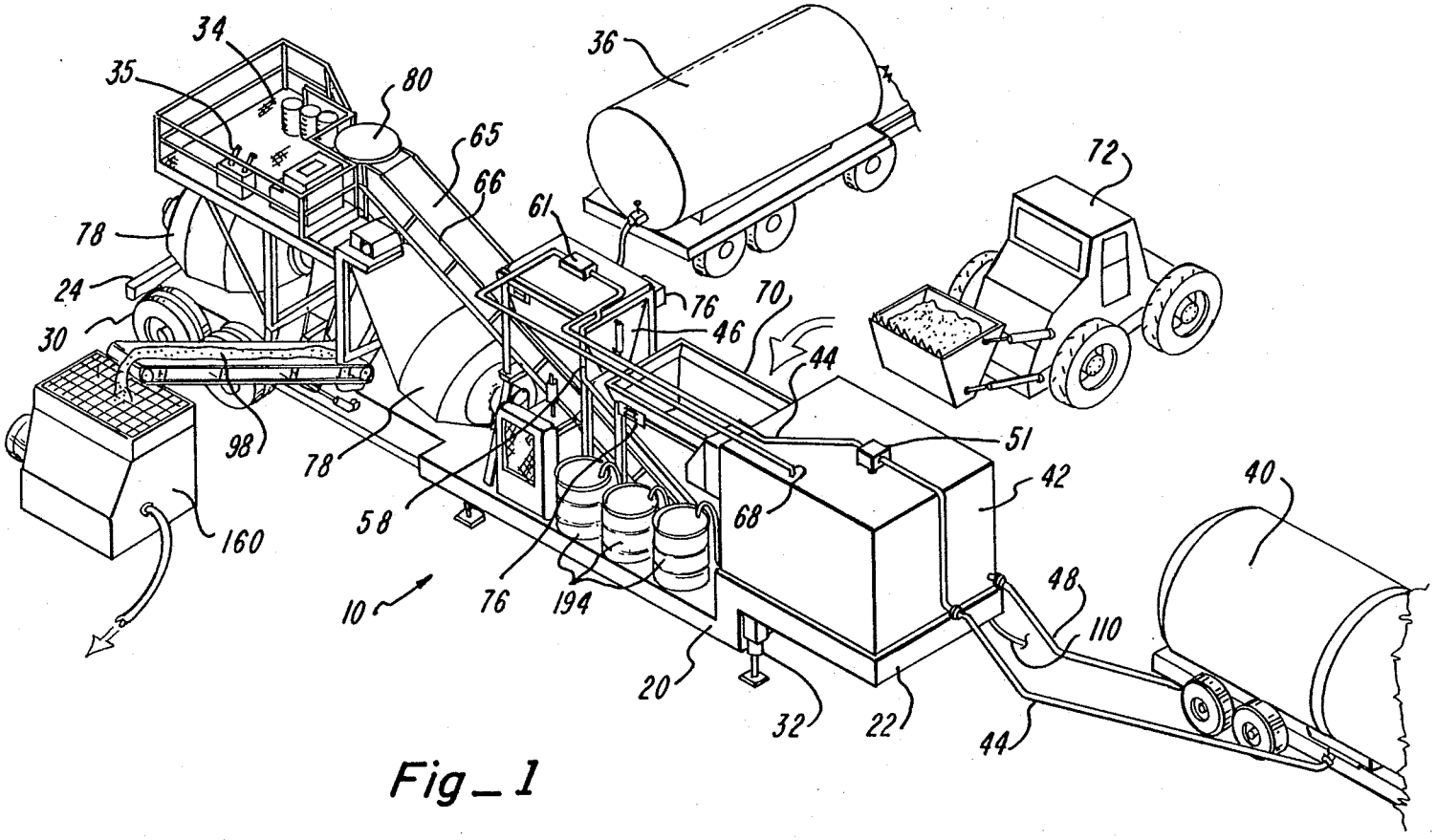
FIG. 1 is a perspective view of a mobile batch plant embodying the invention, showing outside sources of cement, aggregate, and water, as well as a receptacle for the concrete discharged from the plant.

FIG. 1 provides an overview of a mobile concrete batch plant in accordance wit the present invention, and broadly illustrates its operation. Generally considered, plant 10 comprises a trailer bed 20 having a front end 22 and a rear end 24 and on which various components hereafter described are mounted. The front end 22 may be hooked to a truck and the plant 10 may be transported thereby, when fully loaded if desired. Cement from a truck 40 or other external source is delivered to cement storage bin 42 via storage bin delivery duct 44, and is stored in storage bin 42 prior to delivery to cement weigh hopper 46. Alternatively, the cement can be provided directly to cement weigh hopper 46 and bypass cement storage bin 42, if desired. A return duct 48 is provided for emptying bin 42 at the completion of the operating run. Aggregate is loaded to the desired weight into aggregate weigh hopper 70, typically by use of a front-end loader 72. Water is supplied from a truck 36 or other external source to water storage tanks 154, shown in FIG. 12, and up to three admixtures may be stored in admixture barrels 194. Opposite facing concrete mixing drums 78 are mounted at the rear 24 of the trailer bed 20 for mixing the desired materials to produce concrete. Controls are centrally located on control platform 34, where they may be operated by one man.

In operation, the storage bin 42, weigh hoppers 46 and 70, admixture barrels 194, and water storage tanks 154 are loaded as desired. Cement and aggregate are then deposited on charging conveyor 66 from gates (shown and discussed later) in the bottoms of the respective weigh hoppers 46 and 70. The aggregate and cement are delivered to load hopper 80, which deposits its contents onto a load diverter 82, shown in FIG. 4B, which alternately is oriented to deliver the materials to a selected mixing drum 78. The admixture and water are delivered directly to the drum 78 being charged via a system of pipes and controls (shown and described in detail later). The contents of the selected mixing drum 78 are then mixed by rotating the drum 78 a pre-selected number of times based on the concrete specifications desired. Upon completion of the mixing, the drum rotation is reversed, by throwing the appropriate drum rotation lever 35 forcing the concrete from the drum and onto discharge conveyor 158 for removal from the batch plant 10. Discharge conveyor 158 is pivotally mounted and may be pivoted inward relative to the plant 10 for transportation, or pivoted outward for discharging concrete from the plant. The mixing drums 78 are entirely independent of one another, thus allowing preparation of the next succeeding batch of concrete while the current batch is being mixed.

Figure 3:
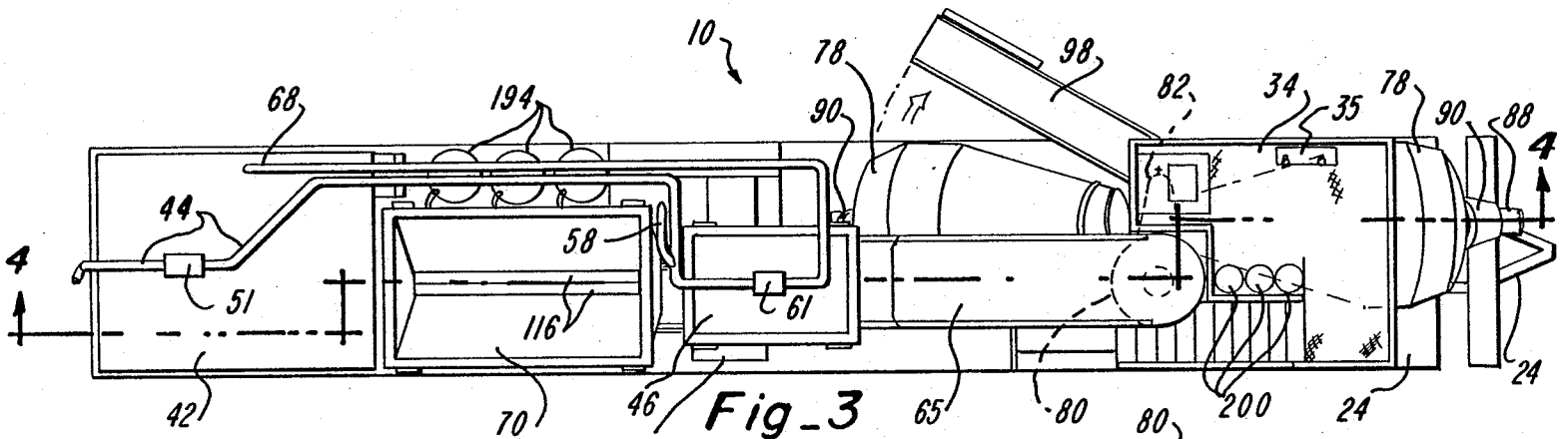
FIG. 3 is a top plan view of the plant of FIG. 2, showing the location of parts of the mixing drum, discharge conveyor, and load hopper.
Figure 2:
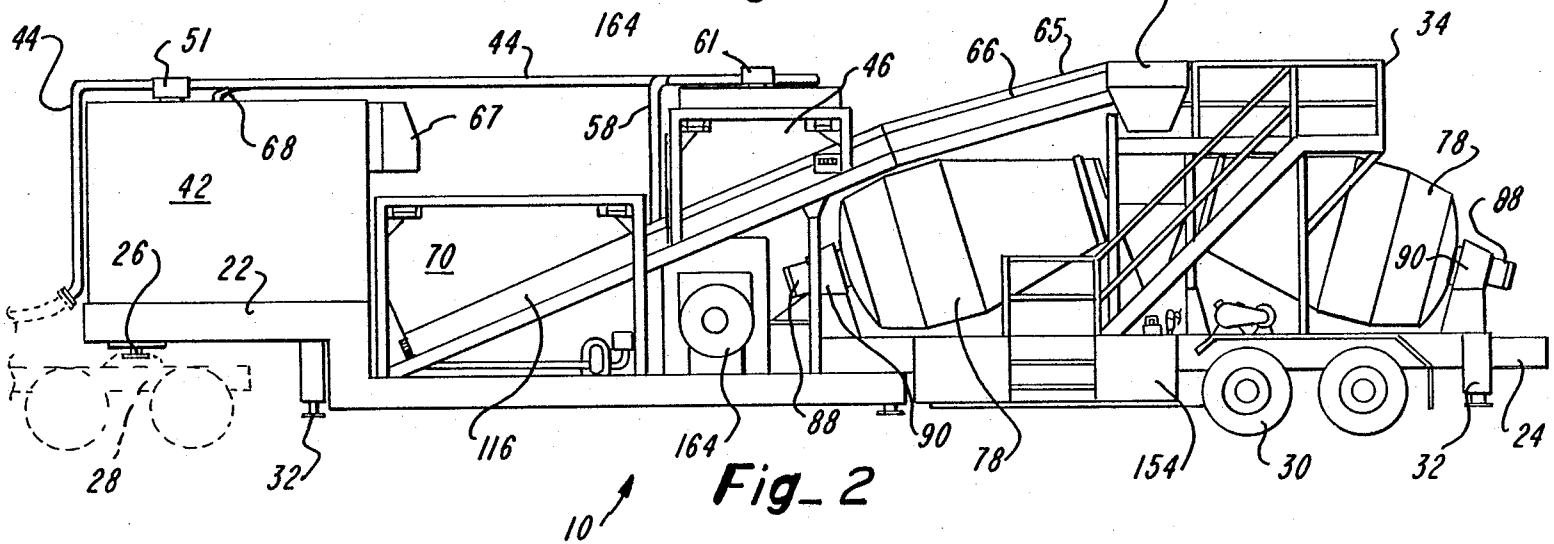
FIG. 2 is a side elevational view of the batch plant of FIG. 1, on a slightly enlarged scale, additionally showing in phantom the rear of the towing tractor and its connection to the plant.

FIG. 2 illustrates the trailer bed 20 in more detail. For towing, the trailer bed towing connector 26 is connected to a towing tractor 28, shown in phantom. The trailer bed has rear wheels 30 suitable for highway travel. Level cylinders 32 are retracted during transportation of the plant and are extended to the ground when the plant is set up, providing support and levelling for the plant. Taken together, FIGS. 2 and 3 give an overall view of the spatial relationship of the various major operating parts of the plant 10.

Figure 4A:
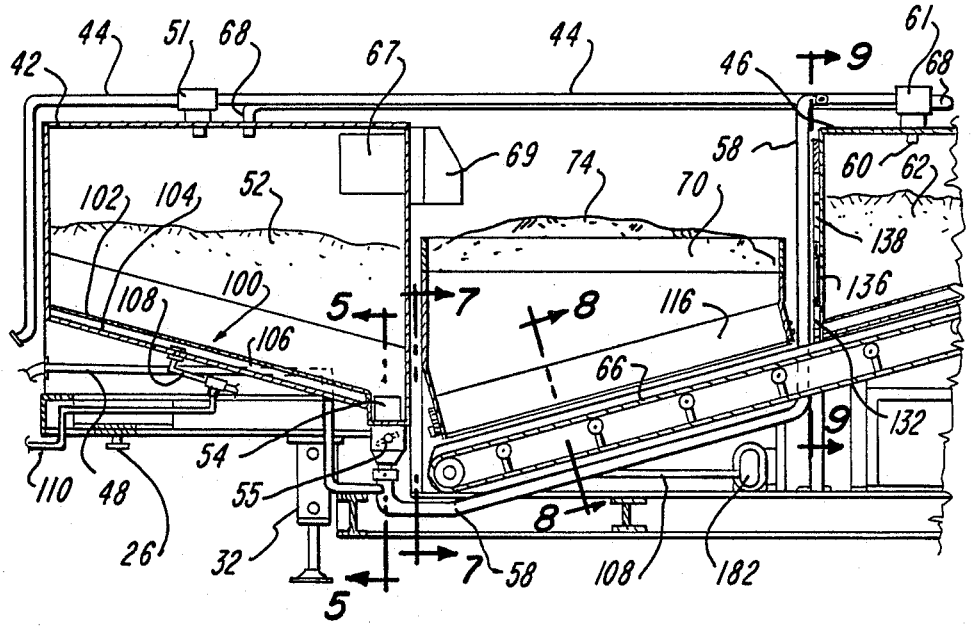
FIG. 4A is a side cross-sectional view of the front half of the plant taken along line 4—4 of FIG. 3, on an enlarged scale.
Figure 11:
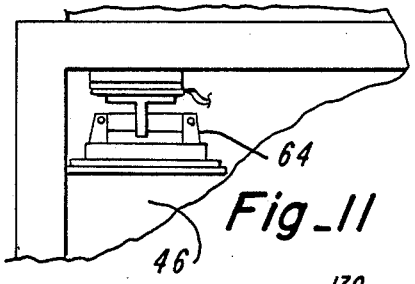
FIG. 11 is an enlarged side view showing the cement weight hopper scale, taken along line 11—11 of FIG. 9.

FIG. 4A illustrates the overall operation of the closed cement storage bin 42 and the closed cement weigh hopper 46. Cement is delivered in a fluidized state to the storage bin 42 via storage bin delivery duct 44 through storage bin inlet port 50, controlled by valve 51. Stored cement 52 is removed from storage bin 42 through discharge chute 54, when discharge valve 55 is opened, an air slide 100 slopes downward toward the discharge chute 54 and further promotes movement of the cement 52 by using air under pressure to agitate the cement along the surface of the air slide. Cement exiting the storage bin 42 through discharge gate 55 enters weigh hopper delivery duct 58. The cement then flows in a fluidized state through the duct 58 and enters the cement weigh hopper 46 through weigh hopper inlet port 60, having a valve 61. As will be readily apparent, cement can be provided directly to weigh hopper 46 from cement truck 40 via duct 44 and bypass the storage bin 42. The purpose of the storage bin is to store excess cement and provide a source of cement when no cement truck is at the construction site. The weigh hopper cement 62 is accumulated in the weigh hopper 46 until it reaches the desired weight as measured by the cement weigh scales 64, shown in FIGS. 9 and 11. The flow from the storage bin 42 is then shut of, and the cement 62 is ready for discharge onto the charging conveyor 66. Conveniently, a cover 65 extends over the upper end of a conveyor 66 to minimize the possibility that cement and aggregate will be blown off the conveyor by ambient wind. A dust filter 67 is located in cement storage bin 42 for air from return duct 68. The air return duct returns air from cement weigh hopper 46. The air from filter 67 is exhausted through the side wall of bin 42 and past a diverter or deflector 69, which minimizes moisture entering bin 42 through filter 67.

The aggregate weigh hopper 70 is also shown in FIG. 4A. Aggregate 74 is loaded into the hopper 70 from an external source to the desired weight, as indicated by digital scale 76, shown in FIG. 1. To charge the mixing drums 78, the cement and aggregate are discharged from the bottoms of their respective hoppers 46 and 70 via discharge gates (shown and discussed later) onto charging conveyor 66, which delivers its load to the mixing drums 78.

The aggregate charge and the cement charge are selected to provide one full load to one of the drums for mixing.

Figure 4B:
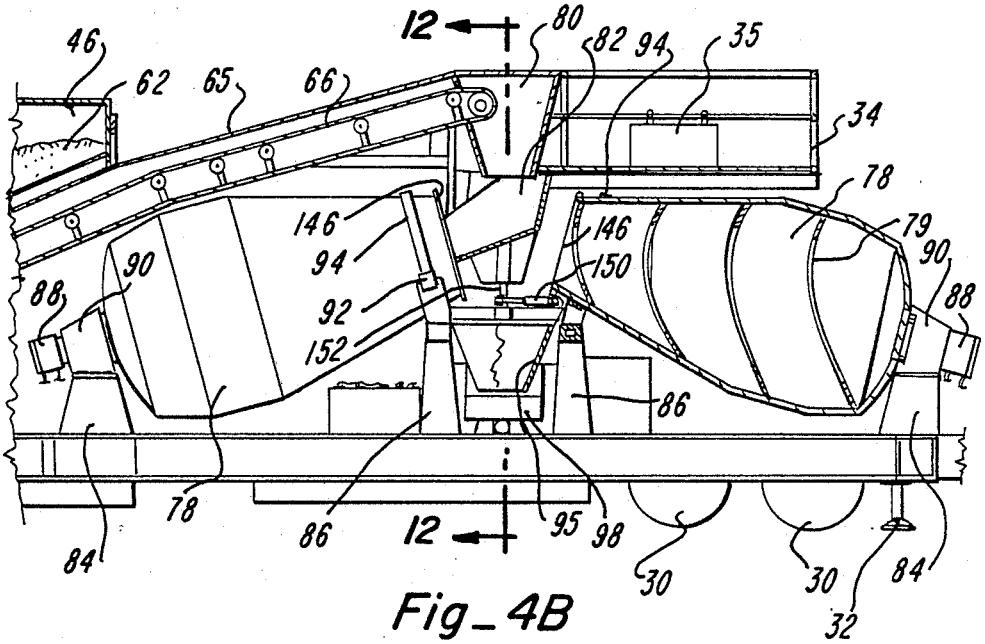
FIG. 4B is a side view of the rear half of the plant taken along line 4—4 of FIG. 3, on an enlarged scale showing cross-sections of the load hopper, the diverter, and the rear mixing drum, including its mixing auger.
Figure 12:
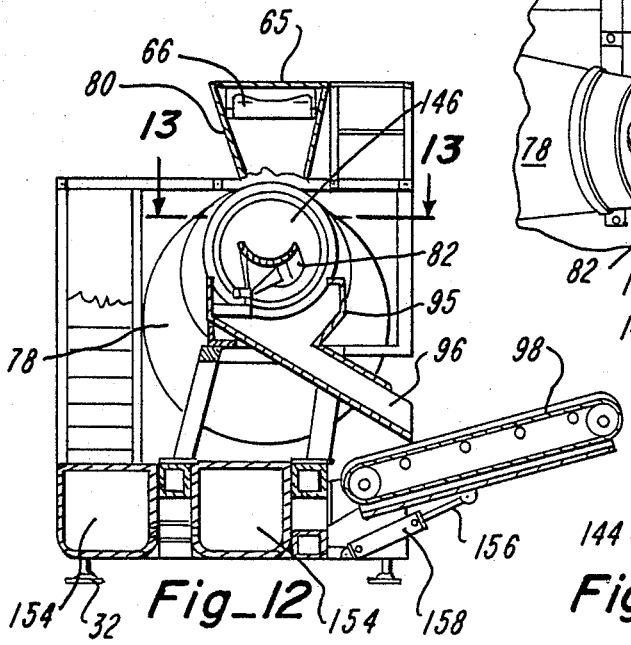
FIG. 12 is a front sectional view taken along line 12—12 of FIG. 4B, showing the load hopper, diverter, front mixing drum, discharge chute, and discharge conveyor of the plant.

Referring now to FIG. 4B, a side view of the rear of the plant is shown. Cement and aggregate are moved via charging conveyor 66 and deposited into covered load hopper 80, which funnels its contents into load diverter 82. Load diverter is oriented toward the mouth of a selected mixing drum 78 for mixing. Each drum 78 is mounted on a drum base 84 and is supported near the mouth 146 by struts 86. In operation, drum motors 88 rotate the drums 78 on bearings 90 and on wheels 92, which ride on wheel tracks 94. A cutaway of the rear drum 78 shows the internal auger 79, which serves to mix the raw materials, as well as to discharge the concrete when the drum 78 is rotated in the opposite direction. As best seen in FIG. 12, the concrete is discharged into concrete discharge chute 96, which directs it onto discharge conveyor 98, which is pivotable in both a horizontal and vertical plane, for removal from the plant 10.

Figure 5:
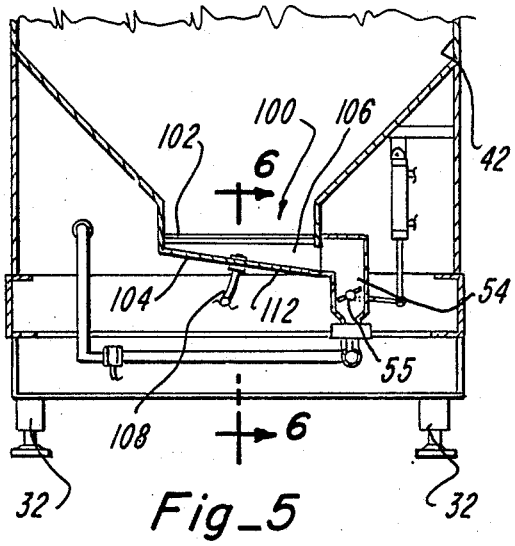
FIG. 5 is a transverse sectional view of the cement storage bin and associated structure taken along line 5—5 of FIG. 4A.
Figure 6:
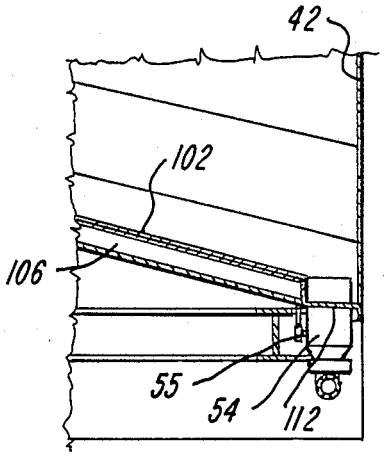
FIG. 6 is a side cross-sectional view of the cement storage bin taken along line 6—6 of FIG. 5.

FIGS. 5 and 6 show the internal arrangement of the cement storage bin 42. An air slide 100 has a porous upper surface 102 and, with the bottom 104 of the bin, defines a plenum 106 into which pressurized air is pumped through air inlet line 108 from air pump 182. Air escaping through the porous surface 102 promotes the flow of cement over the surface 102. The air slide 100 slopes downward toward the front of the bin 42, where the cement slides off of it onto a sloped portion 112 of the bottom 104 of the bin 42. The sloped portion 112 directs the cement into discharge chute 54, through which cement flows when discharge valve 55 is opened.

Figure 7:
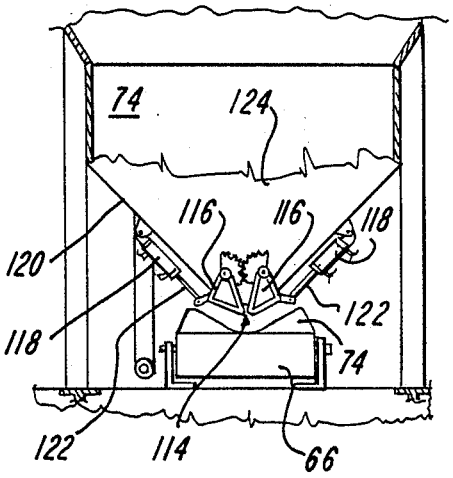
FIG. 7 is a front sectional view showing the aggregate hopper with the gate in the closed position, taken along line 7—7 of FIG. 4A.
Figure 8:
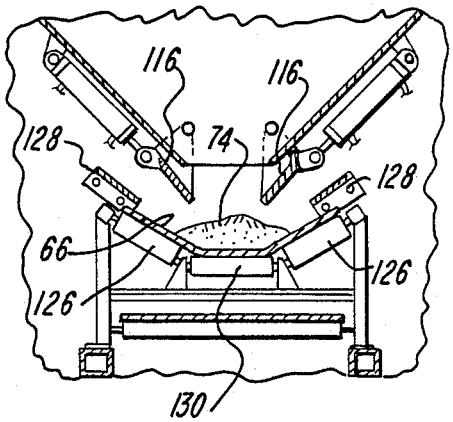
FIG. 8 is a transverse sectional view of the plant taken along line 8—8 of FIG. 4A, showing the gate of the aggregate hopper in the open position with aggregate being deposited on the curved charging conveyor belt.

The aggregate hopper discharge gate 114 and the charging conveyor 66 are shown in detail in FIGS. 7 and 8. Hinged gate doors 116 are attached to hydraulic cylinders 118, which are in turn attached to the sides 120 of the aggregate hopper 70. The cylinders 118 open the gate 114 when the pistons 122 are retracted, as in FIG. 8, and close the gate 114 when the pistons 122 are extended, as in FIG. 7. When the gate 114 is opened, aggregate 74 is discharged onto curved charging conveyor belt 66. Side conveyor rollers 126 are mounted at an angle sloping toward the center of the belt 66, creating a trough in the belt which tends to prevent the aggregate 74 from spilling from the belt 66. To further prevent spillage from the belt, containing plates 128 are mounted along the sides of the belt along the length of the hopper 70, effectively increasing the height of the sides of the conveyor belt 66. A center roller 130 provides additional support for the belt 66.

Figure 9:
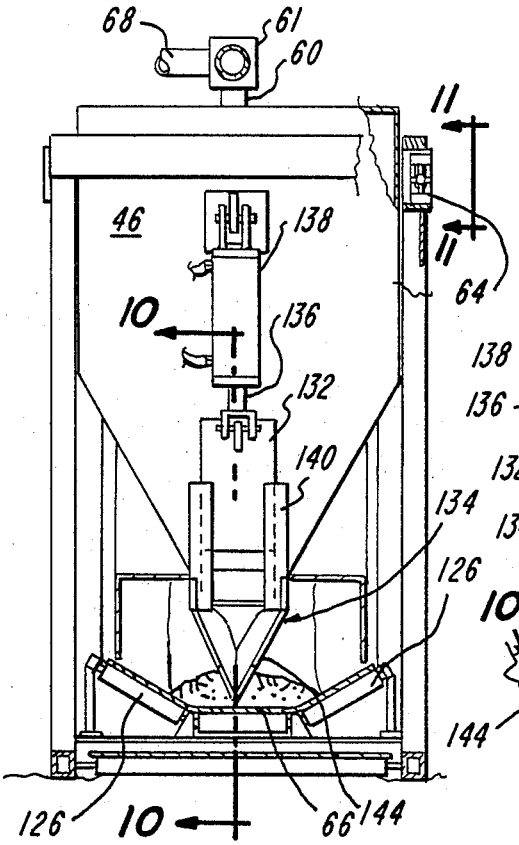
FIG. 9 is a front sectional view of the cement weigh hopper taken along line 9—9 of FIG. 4A, on an enlarged scale, showing the relative positions of the discharge gate, the wedge loader, the aggregate, and the curved charging conveyor belt.
Figure 10:
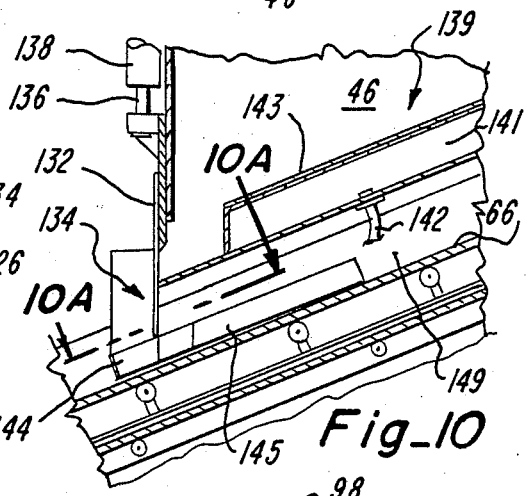
FIG. 10 is a side cross-sectional view of the cement hopper discharge gate, the wedge loader, the aggregate and the conveyor belt of FIG. 9, taken along line 10—10 of FIG. 9.
Figure 10A:
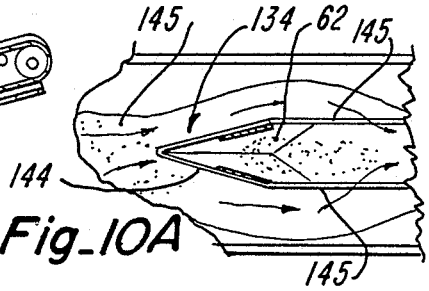
FIG. 10A is a top fragmentary detailed view taken along line 10A—10A of FIG. 10, showing the effect of the wedge loader on the flow of aggregate and cement on the charging conveyor.

Referring now to FIGS. 9, 10 and 10A, the operation of the cement weigh hopper discharge gate 132 and cement loading plow 134 is illustrated in detail Discharge gate 132 is attached to the piston 136 of hydraulic cylinder 138, which opens and closes the gate 132 by moving it up and down in guides 140. When the gate 132 is open, cement is free to flow out the bottom of discharge chute 54 onto the charging conveyor 66. Conveniently, an air slide 139 is provided along the bottom of hopper 46 and has a plenum 141 which is supplied air through duct 142 that passes through porous surface 143 to lift cement 62 for better flow through gate 132. Cement loading plow 134 is integrally attached to the bottom of the weigh hopper 46, directly underneath the discharge chute 54 and above the charging conveyor 66. The plow 134 has a wedge-shaped tip 144 which points upstream relative to the conveyor flow, and parallel sides 145 extending downstream from the outermost edges of the wedge 144. The plow has a clearance over the conveyor 66 which is large enough to allow the conveyor to pass freely under it, and small enough to prevent aggregate from passing between the plow 134 and the conveyor 66. As best seen in FIG. 10A, as aggregate flows past the plow 134, a furrow is created in the mass of aggregate 74 on the conveyor 66 by the wedge 144 and is maintained by the sides 145 as separate parallel streams of aggregate. Cement 62 is discharged behind the wedge 144 and between the sides 145 of the plow 134, inside the furrow. As the mass of aggregate 74 and cement 62 passes the downstream ends of the sides 145, the furrow will tend to collapse or fold over on the cement, thus containing cement dust. This effect is enhanced by the curved charging conveyor 66, which tends to force all the materials to its center.

Figure 13:
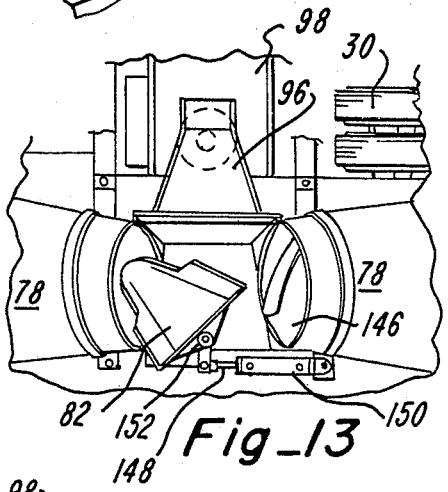
FIG. 13 is a top plan view taken along line 13—13 of FIG. 12, showing the arrangement of the two mixing drums, the diverter, the discharge chute, and the discharge conveyor.

The charging, mixing, and discharging operations may best be seen in FIGS. 12 and 13. Cement and aggregate fall off the end of charging conveyor 66 into load hopper 80, and are thereby funneled into load diverter 82 which is oriented to divert the charge into the mouth 146 of mixing drum 78. The load diverter 82 is attached to piston 148 of hydraulic cylinder 150. By extension or retraction of the piston 148, the load diverter 82 is pivoted about pivot shaft 152 and is oriented toward the mouth 146 of a selected drum 78. Water is added to the drum 78 from water storage tanks 154, admixture is added as desired, and the contents of the drum 78 are mixed by rotating the drum. Reversing the rotation of the drum 78 discharges the finished concrete onto concrete hopper 95 which is formed integrally with discharge chute 96, which directs the concrete onto discharge conveyor 98. Discharge conveyor 98 may be elevated and lowered by extending and retracting the piston 156 of hydraulic cylinder 158. Conveniently, the concrete is carried by discharge conveyor 98 to a suitable hauling device, such as concrete pump 160, shown in FIG. 1, to supply the concrete to its point of use.

Figure 14:
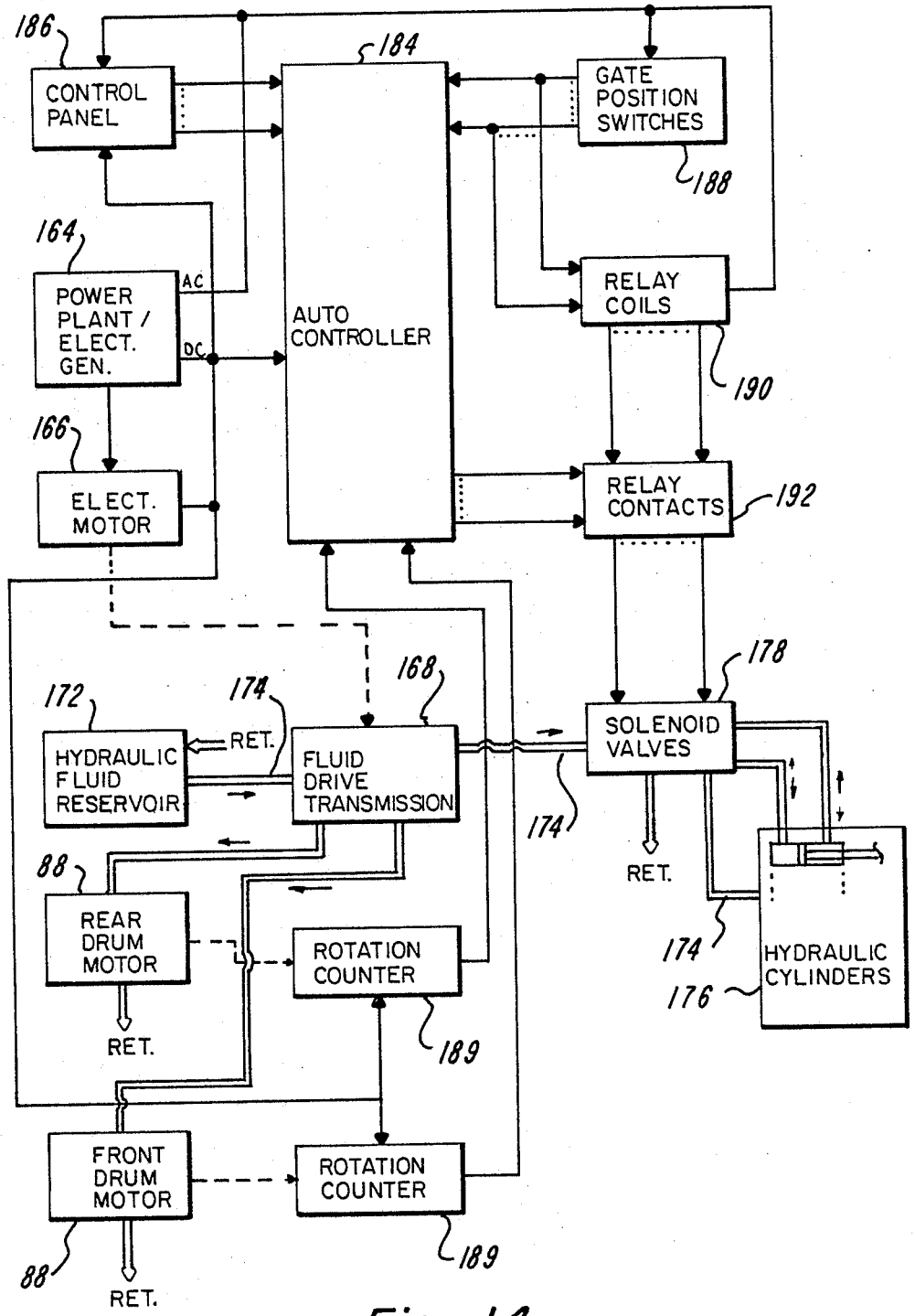
FIG. 14 is a schematic representation of the power and control system of the plant.

Referring now to FIG. 14, the power and control system of the plant 10 is shown and its relationship to the operating parts of the plant is illustrated. Beginning with the power plant 164, a standard electrical generator is used to provide electricity to power the operation of the plant 10. An electric motor 166 powers the fluid drive transmissions 168, which pump fluid from a hydraulic fluid reservoir 172 through fluid lines 174 and the various hydraulic cylinders 176, with this flow controlled by solenoid valves 178 located along the fluid lines 174.

Figure 15:
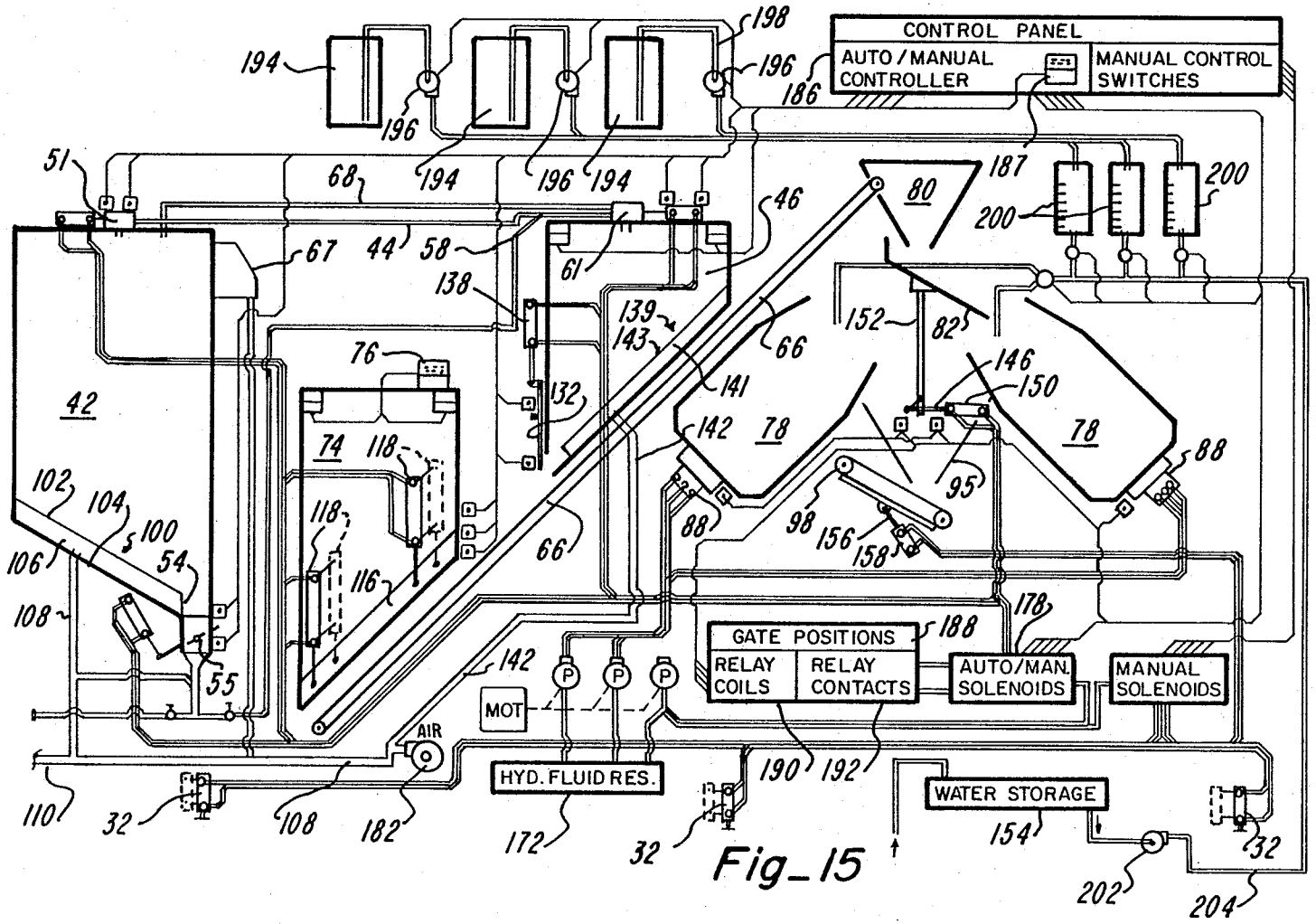
FIG. 15 is a schematic flow diagram showing connections and interactions between the power and control system and the operating parts of the plant.

The previously described closed air pressure system can best be understood by viewing FIG. 15. Air pump 182 provides air to three separate locations for the purpose of fluidizing the cement so that it will flow like a fluid, as is well known in the art. The air flows along duct 108 into duct 110 to cement truck 40 for fluidizing the cement so that it will flow under pressure through duct 44 either to storage bin 42 via valve 51 or to weigh hopper 46 via valve 61. Air is also provided via duct 108 to air slide 100 in storage bin 42 and via duct 142 to air slide 139 in weigh hopper 46.

Suitable controls are provided for the valves and additional valves may be provided as needed and as is apparent to one skilled in the art. It will be understood that when valve 51 is open to permit cement flow into storage bin 43, that valve 61 in weigh hopper 46 will be closed to cement flow but will be open for return of air under pressure in the weigh hopper through return duct 68 to storage bin 42. Since both storage bin 42 and weigh hopper 46 are essentially closed to atmosphere, the air pressure within each will be above atmospheric pressure due to the flow of air into them through the respective air slides. The air which is returned through duct 68 to storage bin 42 and will be exhausted, along with the air in storage bin 42, through filter 67 to atmosphere.

Looking at FIG. 14, control of the system is accomplished either by automatic controller 184, shown in FIG. 14, or by manual control panel 186. A digital readout 187, shown in FIG. 15, is provided to read the weight of cement in the cement weigh hopper 46. Gate position switches 188 provide feedback to the control panel 186 and the automatic controller 184 regarding the status of the various operating parts such as gates, valves, motors, and the like. Rotation counters 189 provide signals to automatic controller 184 to control the length of the sequence of the various functions so that the concrete is mixed for the appropriate length of time. The gate position switches 188 are connected between the automatic controller 184, relay coils 190 and relay contacts 192 and solenoid valves 178 in a configuration which prevents certain undesirable combinations of events from occurring. For example, when a gate position switch is in a position which indicates that one drum 78 is dumping, the other drum will be precluded from dumping at the same time. This is accomplished by the relay coil 190 and relay contacts 192 blocking the electric signal from reaching the solenoid valve 178 which would allow the rotation of the drum 78 to be reversed. In like fashion, the load diverter 82 is prevented from being oriented toward the mouth 146 of a mixing drum 78 when the drum is discharging its contents. Also, charging a weigh hopper and discharging from the same weigh hopper simultaneously is prevented.

FIG. 15 further illustrates the admixture and water systems. Admixture is stored in barrels 194, from where pumps 196 move it through admixture lines 198 to admixture measuring vials 200 located on the control platform 34. When the desired level of admixture is reached in the vials 200, the flow is shut off and the admixture is ready to be added to the mixing drum 78. Water is stored in water storage lo tanks 154, add pump 202 moves it along water line 204 directly to mixing drum 78. The amount of water pumped is controlled by pumping the water at a known rate for a predetermined length of time.

This invention has been described in detail with reference to a particular embodiment thereof, but it will be understood that various. Other modifications can be effected within the spirit and scope of this invention.

What is claimed is:

1. A mobile concrete batch plant for providing a continuous supply of concrete to a construction site, said plant comprising:

a mobile trailer bed with a longitudinal axis and having an upstream end and a downstream end;

an enclosed cement storage bin mounted on the upstream end of said trailer bed in fixed position;

an enclosed cement weigh hopper mounted on said trailer bed in fixed position downstream from said storage bin, said hopper having means for discharging its contents;

air ducts connecting said bin and said hopper;

filtering means for removing cement dust from the air in said bin and said hopper;

air pressure means for transferring cement to said cement storage bin and from said storage bin to said cement weigh hopper;

means for weighing the contents of said cement weigh hopper;

an aggregate weigh hopper mounted on said trailer bed in fixed position downstream from said storage bin, said aggregate weigh hopper having means for discharging its contents;

means for weighing the contents of said aggregate weigh hopper;

two concrete mixing drums mounted in fixed longitudinal alignment with each other on said downstream end of said trailer bed with one mixing drum upstream of the other mixing drum and each mixing drum having a mouth for receiving a charge including cement, aggregate, and water, and for discharging finished concrete, each of said drums having a fixed longitudinal axis of rotation extending through said mouth which lays in a common, vertical, longitudinally extending plane that is generally parallel to said longitudinal axis of said trailer bed, said mouth being elevated relative to the horizontal, and each of said drums having means for rotating them about said axis for mixing said charge to produce concrete;

a trough-shaped endless belt charging conveyor mounted in fixed position on said trailer bed and in communication with said hoppers for receiving cement and aggregate therefrom and delivering it to said mixing drums, said conveyor being inclined upwardly from an upstream end to a downstream end above and parallel to said axis of said upstream mixing drum;

a cement loading plow attached to the bottom of the cement weight hopper, said plow having an upstream-pointing wedge tip having a pair of spaced parallel sides extending downstream, said plow having a clearance over said conveyor large enough to allow free passage of the conveyor under the plow and small enough to prevent aggregate from passing between said plow and said conveyor to separate the aggregate into two parallel streams, with cement being discharged onto the conveyor between said aggregate streams;

a plurality of containers for storage of admixture;

means for selectively delivering said admixture to the mixing drums;

a pivotally mounted, trough-shaped load diverter having an upper and a lower end, said diverter being rotatable to align its upper and with the charging conveyor for receiving the charge therefrom and to align its lower end with the mouth of either of the mixing drums for delivering the charge thereto;

means for directing the charge from the downstream end of said conveyor into said diverter;

means for rotating said diverter into alignment with the charging conveyor and a first selected one of said mixing drums;

means for introducing measured amounts of water into said first selected drum;

means for discharging finished concrete from a second selected one of said drums while said first selected drum is receiving a charge; and vertically and horizontally pivotable discharge conveyor means in communication with said mixing drums for receiving finished concrete.

* * * * *